United States Patent [19]

Linke

[11] 4,139,084

[45] Feb. 13, 1979

[54] HAND LUGGAGE WITH MULTIPLE COMPARTMENTS

[75] Inventor: Norbert H. J. Linke, Milan, Italy

[73] Assignee: S. T. DuPont, Paris, France

[21] Appl. No.: 843,239

[22] Filed: Oct. 18, 1977

Related U.S. Application Data

[63] Continuation of Ser. No. 722,296, Sep. 10, 1976, abandoned.

[51] Int. Cl.[2] ..... A45C 3/00

[52] U.S. Cl. ..... 190/48; 190/52

[58] Field of Search ..... 190/52, 16, 48, 51; 312/285, 290

[56] References Cited

U.S. PATENT DOCUMENTS

| | | | |
|---|---|---|---|
| 1,143,711 | 6/1915 | Kennedy | 190/48 |
| 1,495,046 | 5/1924 | Spiegel | 190/52 |
| 2,055,657 | 9/1936 | Gordon | 190/48 X |

FOREIGN PATENT DOCUMENTS

| | | | |
|---|---|---|---|
| 553428 | 6/1932 | Fed. Rep. of Germany | 190/52 |
| 732690 | 9/1932 | France | 190/52 |
| 358959 | 10/1931 | United Kingdom | 190/52 |
| 415772 | 9/1934 | United Kingdom | 190/52 |
| 585845 | 2/1947 | United Kingdom | 190/52 |

*Primary Examiner*—William Price
*Assistant Examiner*—Joseph Man-Fu Moy
*Attorney, Agent, or Firm*—Richard A. Wise; Mandel E. Slater

[57] ABSTRACT

Hand luggage is disclosed having a plurality of compartments, each of which can be separately opened by means of an outside opening control, and in which all the opening controls are grouped on a single panel.

4 Claims, 3 Drawing Figures

HAND LUGGAGE WITH MULTIPLE COMPARTMENTS

This is a continuation, of application Ser. No. 722,296, filed Sept. 10, 1976 now abandoned.

BACKGROUND OF THE INVENTION

1. Field of the Invention

This invention relates to hand luggage with multiple compartments and more particularly to the means by which the compartments are opened and closed and may be locked.

2. Description of the Prior Art

There are many types of hand luggage, such as suitcases, travel bags, attache cases, vanity cases, brief cases, and the like, all of which may be defined as hand luggage for the purposes of the present invention.

Some hand luggage has a single compartment in which everything being carried is stored together, even though it may be desirable to provide for segregated storage for different types of articles. For this reason various types of hand luggage have been designed, partitioned into multiple compartments by fixed or movable walls, or by drawers, expanding sides, or the like.

It has also been proposed to provide separate compartments, each of which can be opened, directly or not, by means of an exterior opening control. Hand luggage of this type has been disclosed, for example, in U.S. Pat. Nos., 698,558, 803,094, 866,459, 896,529, 1,752,948, and 3,912,055.

It would further be desirable, considering the uncomfortable plight of travelers who may be burdened with many things to carry and have both hands full, to provide hand luggage with compartments that can be separately opened with only one hand, and even more preferable if the opening operations can be performed with the same hand that is simultaneously gripping the handle. None of the hand luggage disclosed in the above-mentioned patents allow such operation; although it would be an advantage for the overburdened traveler to have such a facility in presenting a passport, travel ticket, or the like, without having to set down all the luggage and various items being carried.

SUMMARY OF THE INVENTION

Accordingly it is an object of the present invention to provide hand luggage with handle and multiple compartments in which the opening of any compartment can be controlled by the hand holding the handle.

A further object of the invention is the provision of a single locking means for locking all the opening controls together.

With the above and other objects in view, a feature of the present invention is the provision, in hand luggage having a handle and a plurality of compartments which can be separately opened by outside opening controls, of a single control panel for all the opening controls. In a preferred embodiment of the invention the control panel is placed near the handle.

The above and other features of the invention, including various novel details of construction and combinations of parts, will now be more particularly described with reference to the accompanying drawing and pointed out in the claims. It will be understood that the particular device embodying the invention is shown by illustration only and not as a limitation of the invention.

The principles and features of this inventon may be employed in various and numerous embodiments without departing from the scope of the invention.

BRIEF DESCRIPTION OF THE DRAWING

Reference is made to the accompanying drawing in which is shown an illustrative embodiment of the invention from which its novel features and advantages will be apparent.

DESCRIPTION OF A PREFERRED EMBODIMENT

Figure 3:
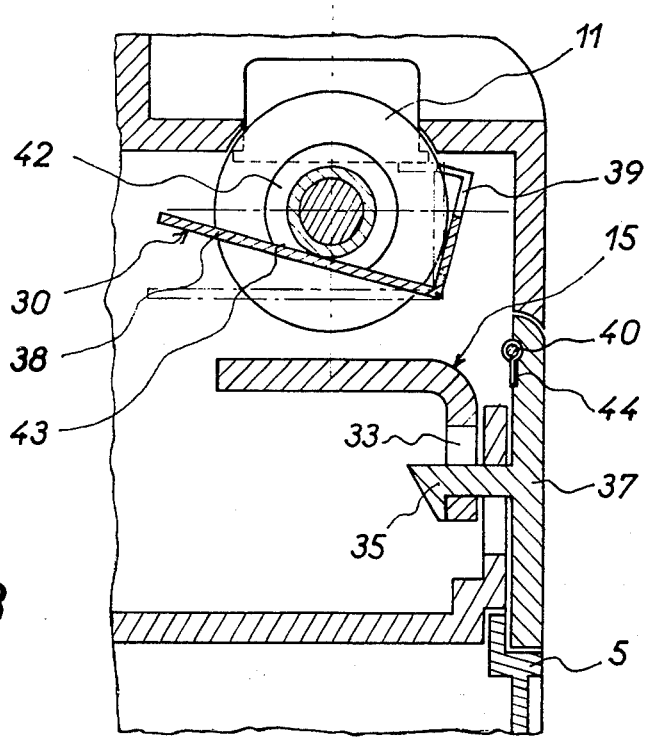
FIG. 3 is a partial sectional view of the opening controls, taken along line III-III of FIG. 2.
Figure 1:
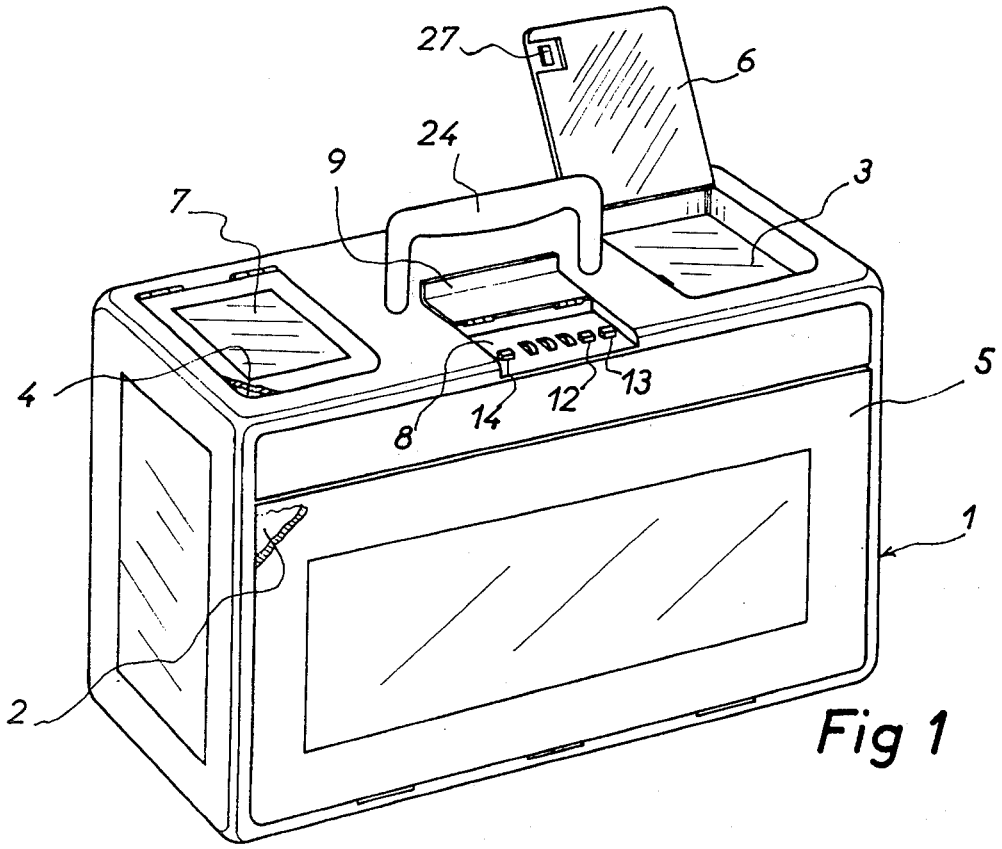
FIG. 1 is a perspective view of an article of hand luggage with multiple compartments, illustrative of the invention, shown with the cover of one compartment open and the covers of two more compartments partially broken away.

Referring to the drawing, an article of hand luggage 1 is provided with a handle 24 connected to the top wall thereof for holding the luggage in upright position and partitioned to form three compartments 2, 3, 4, fixed within the body of the luggage. These compartments are provided respectively with covers 5, 6, 7.

Three individual opening controls 12, 13, 14, which consist of buttons, control respectively the covers 5, 6, 7 and are grouped on a single central panel 8 remote from compartments 2, 3, 4.

This panel is fitted with a cover 9, and the panel is located generally directly below the handle 24, i.e. close to a hand holding this handle.

The button 12 is connected to a vertical rod 18, the lower portion 26 of which has a diameter smaller than the upper portion 25, the two portions forming a shoulder 41 at their junction.

A special L-shaped latch 15 is provided with a round opening 28 in the horizontal wing 16 and with two rectangular openings 33, 34 in the vertical wing 17.

The lower portion 26 of rod 18 extends through opening 28, and a spring 31 seated on a fixed point 32 biases the horizontal wing 16 of the L-shaped latch 15 against shoulder 41 of the rod 18.

The cover 5 is hinged at the bottom, and a flap 37 (see FIG. 3) is used to maintain it in the closed position. A spring 44 provides a biasing force to open the flap 37, which turns about an axis 40 and is fitted with two hooks 35, 36 which respectively can enter the openings 33, 34 and be retained by the latch 15. In this position the hooks 35, 36 prevent the flap 37 from opening, thereby also preventing the cover 5 from opening.

When button 12 is pressed, the shoulder 41 pushes down latch 15 against the force of spring 31 until the apertures 33, 34 arrive in front of hooks 35, 36; then spring 44 opens flap 37, and the cover 5 can be opened. To reclose the cover 5, the flap 37 is folded back so that hooks 35, 36 push down latch 15 against spring 31 until the hooks can enter openings 33, 34. In this position latch 15 moves back up to its original position due to the force of spring 31, thereby securing the flap.

The latching means for the cover 6 consists of a bent lever 19 which swivels about a fulcrum 21. One arm 20 of this lever is fitted with a bolt 22 which can secure the cover 6 by entering a notch 27 under the biasing force of spring 23. When the button 14 is pushed down, lever 19 turns about fulcrum 21 so that bolt 22 is pulled out notch 27; then cover 6 is free and can be opened. The latching means for cover 7 are not shown, being similar and symmetrical to the latching means for the cover 6.

In order to lock the three covers 5, 6, 7 in closed position, there is a single device which consists of a locking latch 30 and a standard combination lock 10. The standard combination lock 10 includes, as is well known in the art, three numbered discs 11 and three rings 42 integral with discs 11 and each formed with a flat portion 43. The locking latch 30 consists of a plate 38 and three projections 39 perpendicular to plate 38.

Figure 2:
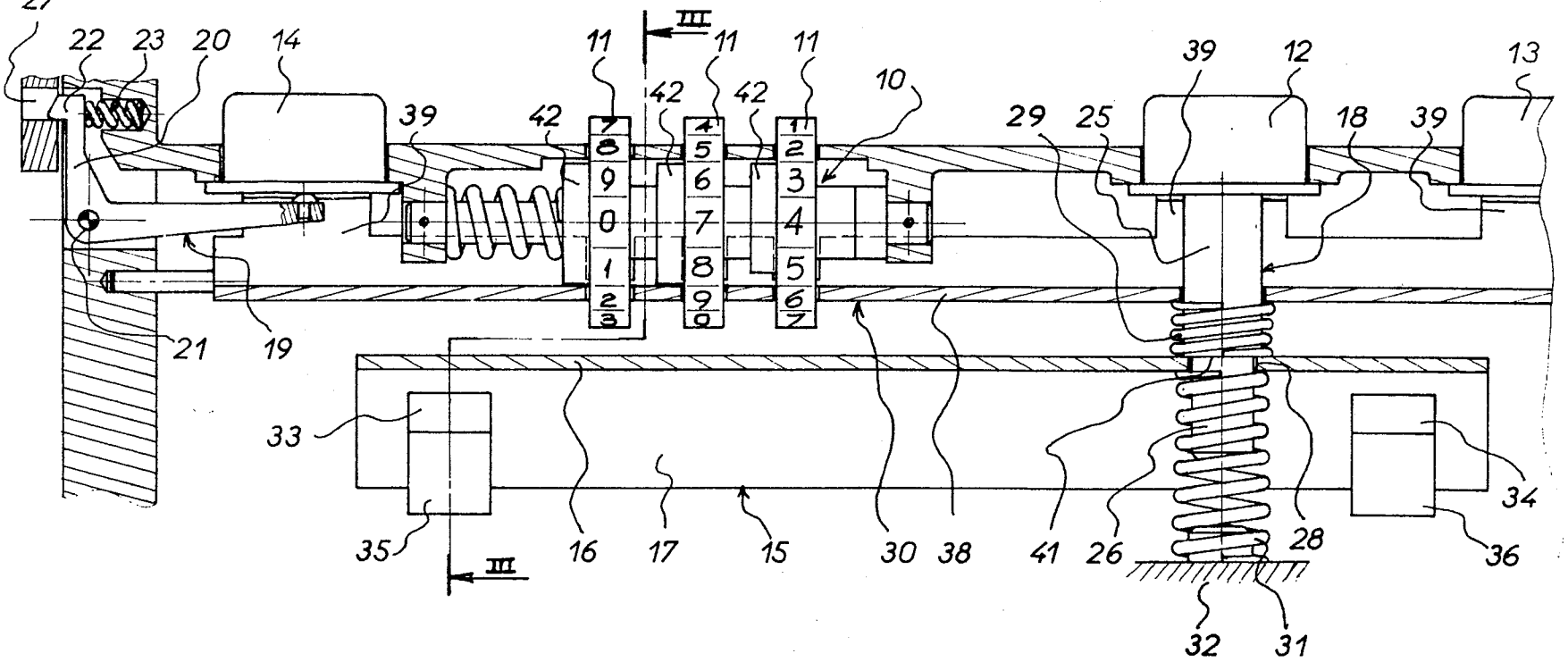
FIG. 2. is an elevational view of the opening controls of the compartments and the sole locking arrangement.

In FIG. 3 the "free" position of locking latch 30 is drawn in solid outline, and the "locking " position is shown in broken lines. In the "locking" position, plate 38 is biased by spring 29 (see FIG. 2) against the round portion of the rings 42; so that projections 39 are directly below opening control buttons 12, 13, 14, which thereby can not be depressed.

To release the buttons 12, 13, 14, it is necessary that the plate 38 be pressed against the flat portion 43 of each of the three rings 42 so that projections 39 are out of the path of the buttons. To this end, it is necessary to rotate the numbered discs 11 until each associated ring 42 comes to the correct angular position.

While various aspects of the invention have been illustrated by the foregoing detailed embodiment, it will be understood that various substitutions of equivalents may be made without departing from the spirit and scope of the invention.

What is claimed is:

1. Hand luggage comprising a top wall; a handle connected to said top wall for holding said hand luggage in upright position; a plurality of fixed compartments in said hand luggage, each of said compartments including a cover, means biasing said cover to open position; and means for securing said cover in closed position, at least one of said compartments and covers therefor being positioned in said top wall and adapted to be opened while said luggage is maintained in said upright position; an individual outside opening-control for each of said compartments adapted to release each cover, each opening-control remote from each compartment; and a single control panel positioned on a portion of said top wall and containing all of said individual outside opening-controls in close juxtaposition.

2. Hand luggage as defined in claim 1, and further including means for locking at least one of said outside opening controls, and means on said single control panel for operating said locking means.

3. Hand luggage as defined in claim 2, in which said locking means is operable to lock all of said outside opening controls.

4. Hand luggage as defined in claim 1, in which said single control panel is located adjacent to said handle.

* * * * *